US012196207B2

(12) United States Patent
Despesse et al.

(10) Patent No.: US 12,196,207 B2
(45) Date of Patent: Jan. 14, 2025

(54) LUBRICANT-SEALED VACUUM PUMP, LUBRICANT FILTER AND METHOD

(71) Applicant: Leybold France S.A.S., Bourg-lès-Valence (FR)

(72) Inventors: Christophe Despesse, Bourg-lès-Valence (FR); Christian Moulin, Bourg-lès-Valence (FR); Frederic Piu, Bourg-lès-Valence (FR); Benoit Reynaud, Bourg-lès-Valence (FR); Mickael Serayet, Bourg-lès-Valence (FR)

(73) Assignee: Leybold France SAS, Bourg-les-Valence (FR)

( * ) Notice: Subject to any disclaimer, the term of this patent is extended or adjusted under 35 U.S.C. 154(b) by 33 days.

(21) Appl. No.: 17/786,051

(22) PCT Filed: Dec. 11, 2020

(86) PCT No.: PCT/EP2020/085709

§ 371 (c)(1),
(2) Date: Jun. 16, 2022

(87) PCT Pub. No.: WO2021/122360

PCT Pub. Date: Jun. 24, 2021

(65) Prior Publication Data

US 2023/0296096 A1 Sep. 21, 2023

(30) Foreign Application Priority Data

Dec. 19, 2019 (EP) ..... 19306693

(51) Int. Cl.

| | |
|---|---|
| ***F04C 29/02*** | (2006.01) |
| ***F04C 25/02*** | (2006.01) |
| ***F04C 28/08*** | (2006.01) |

(52) U.S. Cl.
CPC ..... *F04C 28/08* (2013.01); *F04C 25/02* (2013.01); *F04C 29/026* (2013.01);
(Continued)

(58) Field of Classification Search
CPC ..... F04C 28/08; F04C 25/02; F04C 29/026; F04C 2240/40; F04C 2240/81;
(Continued)

(56) References Cited

U.S. PATENT DOCUMENTS

| | | | |
|---|---|---|---|
| 4,664,601 | A | 5/1987 | Uchida et al. |
| 5,069,792 | A | 12/1991 | Prince et al. |

(Continued)

FOREIGN PATENT DOCUMENTS

| | | | |
|---|---|---|---|
| CN | 1140805 | A | 1/1997 |
| CN | 106999851 | A | 8/2017 |

(Continued)

OTHER PUBLICATIONS

DE-3711143-A1 English Translation (Year: 1987).*

(Continued)

*Primary Examiner* — Dominick L Plakkoottam
(74) *Attorney, Agent, or Firm* — Theodore M. Magee; Westman, Champlin & Koehler, P.A.

(57) ABSTRACT

A lubricant-sealed vacuum pump configured to pump fluid from an inlet to an exhaust, method and filter are disclosed. The lubricant-sealed vacuum pump comprises: a rotor; a filter for filtering lubricant from fluid to be output by the pump; control circuitry for controlling a speed of rotation of the rotor, the control circuitry being configured to control rotation of the rotor, such that the rotor rotates at a reduced speed initially when a pressure at the inlet is high and rotates at a higher operational speed when the pressure at the inlet has reduced.

4 Claims, 6 Drawing Sheets

(52) U.S. Cl.
CPC ..... *F04C 2240/40* (2013.01); *F04C 2240/81* (2013.01); *F04C 2270/20* (2013.01)

(58) Field of Classification Search
CPC .. F04C 2270/20; F04C 28/06; F04C 2220/12; F04C 2270/18; F04C 23/02; F04C 29/0085; F04B 35/04; F04B 37/14; F04B 39/023; F04B 39/16; F04B 49/20
See application file for complete search history.

(56) References Cited

U.S. PATENT DOCUMENTS

| | | | | |
|---|---|---|---|---|
| 6,375,431 | B1 | 4/2002 | Ando | |
| 2004/0265135 | A1 | 12/2004 | Carboneri et al. | |
| 2007/0071610 | A1 | 3/2007 | Holzemer et al. | |
| 2007/0169997 | A1* | 7/2007 | Delaloye | F04B 49/20 184/6.11 |
| 2008/0063536 | A1 | 3/2008 | Koshizaka et al. | |
| 2010/0028165 | A1 | 2/2010 | Kameya et al. | |
| 2010/0047080 | A1* | 2/2010 | Bruce | F04C 28/06 417/44.2 |
| 2011/0200450 | A1* | 8/2011 | Shelley | F04B 37/14 417/1 |
| 2012/0011876 | A1 | 1/2012 | Sata et al. | |
| 2015/0059300 | A1 | 3/2015 | Biswas et al. | |
| 2017/0157566 | A1 | 6/2017 | Gefroh et al. | |
| 2017/0298935 | A1 | 10/2017 | Muller et al. | |
| 2017/0350397 | A1* | 12/2017 | Coeckelbergs | F04C 25/02 |
| 2019/0120231 | A1 | 4/2019 | Obrist et al. | |
| 2019/0224596 | A1* | 7/2019 | Kariveti | B01D 61/08 |
| 2020/0165769 | A1* | 5/2020 | Nernberger | D06F 75/12 |
| 2021/0310488 | A1* | 10/2021 | Coeckelbergs | F04D 27/001 |

FOREIGN PATENT DOCUMENTS

| | | | | |
|---|---|---|---|---|
| CN | 107002680 | A | 8/2017 | |
| DE | 3711143 | A1 * | 10/1987 | |
| DE | 202014000199 | U1 | 4/2015 | |
| GB | 2571968 | A | 9/2019 | |
| JP | 1983186186 | U | 12/1983 | |
| JP | S61167197 | A | 7/1986 | |
| JP | H07289948 | A | 11/1995 | |
| JP | 2012154315 | A | 8/2012 | |
| JP | 2017120061 | A | 7/2017 | |
| KR | 20150012649 | A | 2/2015 | |
| WO | WO-2010052060 | A2 * | 5/2010 | F04C 23/001 |
| WO | 2012032354 | A1 | 3/2012 | |

OTHER PUBLICATIONS

British Examination Report dated Jul. 2, 2020 and Search Report dated Jul. 1, 2020 for corresponding British application Serial No. GB2001758.8, 6 pages.

PCT Notification of Transmittal of the International Search Report and the Written Opinion of the International Searching Authority, or the Declaration dated Feb. 9, 2021 and International Search Reports dated Feb. 9, 2021 for corresponding PCT application Serial No. PCT/EP2020/085709, 6 pages.

PCT Written Opinion of the International Searching Authority dated Feb. 9, 2021 for corresponding PCT application Serial No. PCT/EP2020/085709, 7 pages.

Chinese Office Action dated Dec. 7, 2023 and Search Report dated Dec. 7, 2023 for corresponding Chinese application Serial No. CN202080087770.8, 8 pages.

Shi Jun et al., "Technical Handbook of Membrane," 1st edition, Chemical Industry Press, dated Jan. 31, 2001, pp. 60-64.

European Communication dated Aug. 7, 2024 for corresponding European application Serial No. 20820232.5, 14 pages.

Chinese Notice of Attending to Patent Registration dated Oct. 23, 2024 and Search Report dated Oct. 21, 2024 for corresponding Chinese application Serial No. 2020800877708, 5 pages.

Japanese Notification of Reason for Rejection dated Sep. 26, 2024 for corresponding Japanese application Serial No. 2022-538260, 7 pages.

* cited by examiner

LUBRICANT-SEALED VACUUM PUMP, LUBRICANT FILTER AND METHOD

CROSS-REFERENCE OF RELATED APPLICATION

This application is a Section 371 National Stage Application of International Application No. PCT/EP2020/085709, filed Dec. 11, 2020, which is incorporated by reference in its entirety and published as WO 2021/122360 A1 on Jun. 24, 2021, the content of which is hereby incorporated by reference in its entirety and which claims priority of European Application No. 19306693.3, filed Dec. 19, 2019.

FIELD

The field of the invention relates to lubricant- or oil-sealed vacuum pumps.

BACKGROUND

The size of a lubricant-sealed vacuum pump is dependent to a significant extent on the size of the lubricant filter that is used to filter lubricant from the fluid exhausted by the pump.

The lubricant mist filter is an important part of the pump, as it cleans lubricant from the exhausted fluid. The filter must be large enough to permit the required air flow to pass without introducing a significant pressure drop and it must also provide the desired filtration effects. This means that a significant exchange surface and filter size are required.

It would be desirable to provide a pump and method of pumping that allowed a reduced-sized filter to effectively filter the exhaust gases and also to provide a reduced-sized filter for such a pump.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides, a lubricant-sealed vacuum pump configured to pump fluid from an inlet to an exhaust, said lubricant-sealed vacuum pump comprising: a rotor; a motor for rotating said rotor; a filter for filtering lubricant from fluid to be output by said pump; and control circuitry for controlling a speed of rotation of said rotor, said control circuitry being configured to control rotation of said rotor, such that said rotor rotates at a selected reduced speed initially when a pressure at said inlet is high and rotates at a higher operational speed when said pressure at said inlet has reduced.

The inventors of the present invention recognized that the filter size required for a particular pump depends on the maximum fluid flow through the filter. They also recognized that this occurs when the pump is pumping the maximum volume of air from the customer chamber, and that this happens at the start of the chamber evacuation, when the pressure in the chamber is highest generally when it is at atmospheric pressure. Furthermore, this only occurs for a fraction of the pump's operational time, pumps generally operating for the majority of their time maintaining a chamber at or close to a desired operational vacuum. Thus, the inventors realized that sizing the filter based on the fluid flow at initial pump down results in a filter that is oversized for the majority of the pump's operation.

They recognized that a smaller sized filter could be used were the pump to be provided with control circuitry to control a speed of rotation of a rotor and in particular, to reduce the initial speed of rotation. In this way at the start of pumping, when the chamber is being evacuated from its initial higher pressure, the rotation speed is set to a selected reduced speed, and the corresponding maximum flow rate seen by the filter is also correspondingly reduced. This allows a smaller filter to be selected than is conventionally the case. One drawback of this is that the time required to pump the chamber down to the working pressure is increased. However, as noted previously this is a small amount of the total time or operation of the pump and thus, this is generally an entirely acceptable compromise.

Although the rotational speed of the rotor may be controlled in a number of ways, perhaps using a gearing or braking mechanism, in some embodiments, said motor comprises a variable speed motor for driving said rotor, said control circuitry being configured to control said speed of rotation of said rotor by controlling a speed of rotation of said motor.

Pumps may be fitted with a variable speed motor to drive the rotor and this can be used to provide the controlled reduced initial speed of the rotor. One example of such an arrangement is where the pump comprises a frequency converter for converting a single phase power supply to a 3-phase supply for powering the motor. Such a frequency converter can also be used to modify the speed of the motor, and where such a convertor is present within the pump, this can be done without any additional components beyond the control circuitry being added. Modifying the speed of the motor that is driving the rotor is a convenient and effective way of controlling rotor speed.

In some embodiments, said lubricant-sealed vacuum pump comprises a sensor for sensing a property of the fluid being pumped, said property being indicative of the pressure at the inlet and said control circuitry comprises a feedback control system for controlling the speed of the rotor in dependence upon the sensed property.

The sensor may be at least one of: a pressure sensor configured to sense a pressure of a fluid being pumped and a flow-rate sensor configured to sense a flow rate of a fluid being pumped, said control circuitry being configured to control said speed of rotation of said rotor in response to a signal from said at least one of said pressure sensor and said flow-rate sensor.

Where the rotational speed of the rotor is controlled in dependence upon a sensed property of the fluid being pumped then a sensor for sensing a property of the fluid is required. This sensor may sense the pumping speed or flow rate of the fluid—that may be either the mass flow rate or the volumetric flow rate, or it may be the pressure of the fluid being pumped that is sensed. This pressure may be measured directly perhaps at the inlet or at the outlet, or it may be measured indirectly by, for example using a current sensor sensing current supplied to the motor, the current being indicative of the required torque and thus, of the pressure of the fluid being pumped. It would be understood by a skilled person that a sensor configured to directly measure pressure may be used to derive flow rate and similarly a flow rate sensor configured to directly measure flow rate may be used to derive pressure.

Given that the aim of the reduced initial speed of the rotor is to limit the maximum fluid flow rate and thus, the required size of the lubricant filter, controlling the rotational speed in dependence upon factors that are related to the flow rate, such as the flow rate itself or the fluid pressure, enables the control to provide a rotational speed that is accurately linked to a particular flow rate. This enables the flow rate to be maintained below a desired value and in some embodiments to be maintained at or is close to the maximum allowed flow rate, thereby not unduly increasing the initial pump down time, while still maintaining the flow within the limits required by the filter.

In some embodiments, said reduced speed is a fixed reduced speed and said control circuitry is configured to control said rotor to rotate at said fixed reduced speed for a predetermined period, and to increase said speed to said higher operational speed after said predetermined period.

One simple control mechanism may be to control the rotor to rotate at a reduced constant, fixed speed for an initial predetermined period and to increase the speed to the higher operational, steady state, speed of the pump after this period. In this way the pump operates substantially at two different speeds, the point at which the rotor accelerates to the higher speed determining the maximum fluid flow that the pump will pump.

In some embodiments, said predetermined period comprises a predetermined period of time.

The control circuitry may be configured to control a pump for evacuation of a particular chamber or type of chamber and/or for a particular application and in such a case, the pump may be configured simply to pump at the reduced speed for a predetermined period of time, this time being selected in dependence upon the desired maximum fluid flow, and determined from the properties of the pump and the chamber. In this way no additional sensors are required, the control circuitry simply controlling the pump in dependence upon the time passed.

In other embodiments, said predetermined period comprises a period while a pressure is above a predetermined value.

Alternatively, the pump may pump at the reduced speed while the pressure of the fluid being pumped is above a certain value. This pressure may be the pressure at the inlet, or the pressure at the outlet, or the pressure within the pumping chamber, depending on the location of the pressure sensor, the predetermined value being selected accordingly.

In other embodiments, said predetermined period comprises a period while a flow rate of said fluid being pumped is greater than a predetermined amount.

Alternatively, the pump may change the pumping speed in dependence upon the flow rate of the fluid being pumped. This is a convenient way of limiting the flow rate of the fluid being pumped, but does require some type of flow rate sensor.

Although, in some cases the selected initial reduced speed may be held at a constant value for a predetermined period, in other embodiments, said reduced speed is a variable reduced speed.

Although using a constant reduced speed of rotation may be simpler to control, a variable reduced speed may be more effective, and allow the speed to be increased gradually as the pressure reduces. This allows the flow rate to be maintained close to a desired value during the pump down and reduces the time taken to achieve pump down.

In some embodiments, said control circuitry is configured to set said variable reduced speed in dependence upon a signal received from said at least one sensor.

The variations in the reduced speed may be controlled in dependence upon the measured changes in flow rate and/or pressure. In this way as pressure and flow rate decrease, the speed can be increased without exceeding a maximum flow rate.

In some embodiments, said at least one sensor comprises said flow rate sensor and said control circuitry is configured to set said variable reduced speed to provide a predetermined fluid flow rate.

As noted previously the idea of the reduced initial speed is to limit the maximum flow rate, thus, one effective way of controlling the reduced speed is to control the speed in dependence upon the flow rate, this allows it to be maintained below but close to a maximum level that in some embodiments, the filter has been configured to support.

In some embodiments, said at least one sensor comprises said pressure sensor and said control circuitry is configured to set said variable reduced speed in dependence upon a signal from said pressure sensor, said speed being increased in response to said pressure decreasing.

Alternatively, the speed may be set in dependence upon the pressure, the flow rate being dependent upon the pressure and speed of rotation and thus, can be controlled by controlling the speed in dependence upon the pressure.

In some embodiments, said control circuitry is configured to maintain said rotor speed at said higher operational speed when said speed of rotation of said rotor has increased to said higher operational speed.

Where the selected initial reduced speed of rotation is variable, it will be controlled to increase gradually as the chamber is evacuated. At some point the gradually increased speed will reach the operational speed of the pump, and at this point the increase in speed will stop and the pump will operate at this higher operational speed continuously.

In some embodiments, said filter is a reduced sized filter, said filter being sized for filtering a predetermined maximum flow rate of fluid pumped by said lubricant-sealed vacuum pump, said control circuitry being configured to maintain said flow rate of fluid being pumped below said maximum flow rate by controlling said rotor to rotate initially at said reduced speed.

In some embodiments, said selected initial reduced speed is less than a half of said higher operational speed. In some embodiments, said selected initial reduced speed is less than a third of said higher operational speed, in some cases it is less than a quarter of said higher operational speed.

A second aspect provides a method of evacuating a chamber using a lubricant-sealed pump according to a first aspect, said method comprising: rotating a rotor of said pump at a selected initial reduced speed for a predetermined period; and increasing a rotational speed of said rotor to a higher operational speed after a predetermined period.

In some embodiments, said method further comprises: sensing at least one of a pressure and a flow rate of said fluid being pumped; and controlling said rotational speed of said rotor in dependence upon at least one of said sensed pressure and said sensed flow rate of said fluid.

A third aspect provides a reduced-sized filter for a lubricant-sealed vacuum pump according to a first aspect, said reduced-sized filter comprising a filtration surface area that is smaller than or equal to the volumetric flow rate of the pump at the selected initial reduced speed that the pump is configured to provide divided by the permeability and pressure drop across the filter.

The permeability and pressure drop across the filter are properties of the filter and thus, the reduction in surface area will depend on the reduction in maximum flow rate. Thus, where the selected initial reduced speed is a fraction of the operational speed the filtration surface will be correspondingly reduced.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in any more detail, first an overview will be provided.

In order to reduce the flow passing through a lubricant-sealed pump and filter, the pumping speed is reduced when the pump is started as at this point flow rate is generally at its highest. This is done by varying the rotational speed of the rotor. As an example we can do this in two ways:

1. Constant limited speed during startup;
2. Variable ramped-up speed during startup;
3. Variable speed at startup adjusted in response to detected properties of the fluid being pumped, in order to have a constant flow at exhaust.

This allows us to substantially reduce the filter size by modifying the starting speed of the pump and in this way the maximum flow rate that passes through by the pump and the filter.

Figure 1:
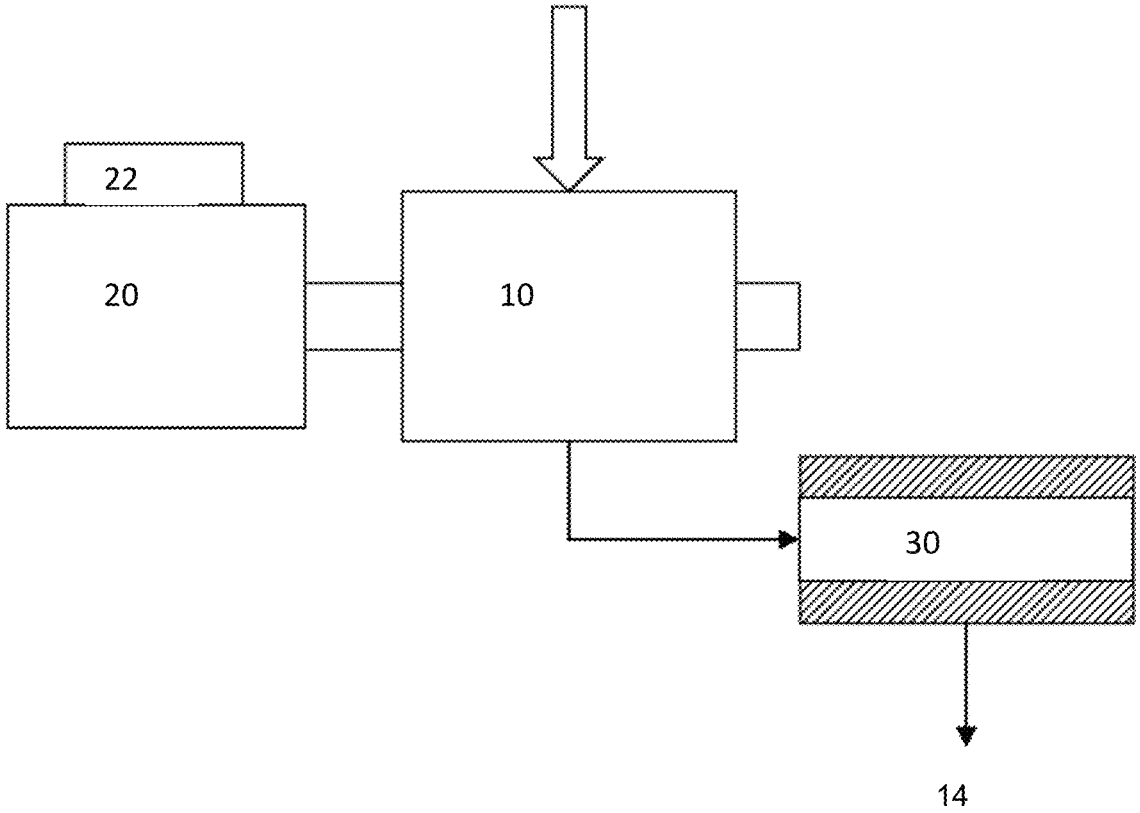
FIG. 1 schematically shows a vacuum pump according to an embodiment.

FIG. 1 shows an oil-sealed pump according to an embodiment. The oil-sealed pump comprises a motor 20 for driving a rotor 10 within a pumping chamber (not shown). The rotor 10 pumps fluid that arrives at an inlet marked by arrow 12 through the pumping chamber to a filter 30 which acts to remove oil mist from the pumped fluid, the fluid being exhausted at exhaust 14.

The motor 20 is a variable speed motor and the speed of the motor and thus the speed of rotation of the rotor is controlled by control circuitry 22. In this embodiment, control circuitry 22 is configured to control the motor to rotate at an initially reduced speed for a predetermined time and then to accelerate up to full operational speed after that time. In this embodiment, the initial speed is about a quarter of the full operational speed and the pump is configured to operate at this reduced speed during start up for approximately 20 seconds. The result of this is that when the pressure is initially high in the chamber being evacuated the rotational speed is low and thus, the flow rate of the fluid through the pump is reduced compared to a conventional pump. Once the pressure in the chamber has reduced the speed of rotation of the rotor is increased to the normal operational speed. At this point as the pressure in the chamber is reduced, although the rotor starts rotating at the faster speed the flow rate of fluid through the pump is not as high as had the rotor rotated at this higher speed initially. In this way, the maximum flow rate that goes through filter 30 is reduced and the size of the filter can be correspondingly reduced.

The time to pump down the chamber to the working pressure is increased owing to the initial lower speed however this is generally acceptable as this is only a very small fraction of the time of operation of the pump.

In the embodiment of FIG. 1 the control circuitry 22 is configured to control the rotor to operate at a constant slower speed for a predetermined time. In other embodiments the control circuitry may be configured to operate at a slower initial speed and to gradually ramp up over time to the higher operational speed. Where the pump is configured to evacuate a chamber with known dimensions or with dimensions within certain known limits then restricting the speed of rotation based on time of operation is acceptable as the pressure reduction that occurs at this time can be estimated, based on the known dimensions and pump speed, allowing the time to be selected such that the operational speed increases when the pressure within the chamber has dropped sufficiently to enable the flow rate not to exceed a certain maximum value that the filter 30 has been configured to support.

Figure 2:
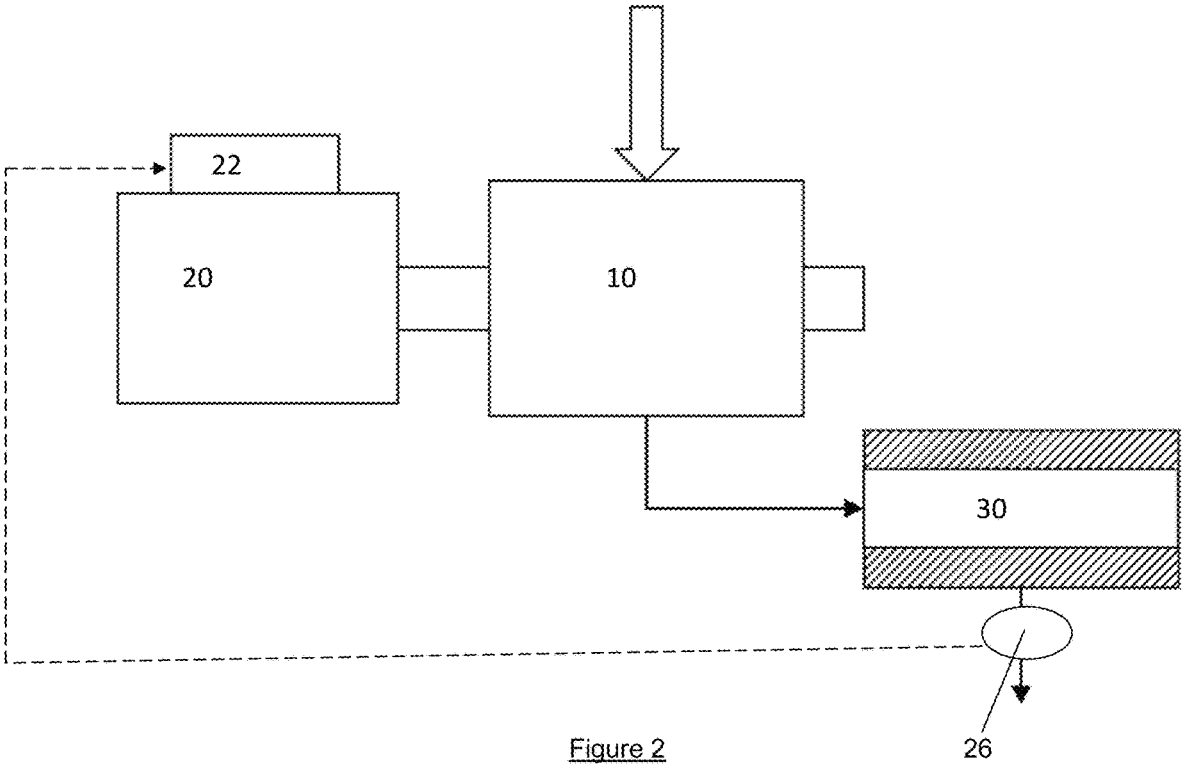
FIG. 2 schematically shows a vacuum pump where the rotational speed is controlled in dependence upon flow rate according to an embodiment.

FIG. 2 shows an alternative embodiment where rather than the control circuitry being configured to pump at a reduced speed for a predetermined time the control circuitry is configured to receive signals from a flow rate sensor 26. Flow rate sensor 26 measures the flow rate at the exhaust of the pump and transmits a signal indicative of this flow rate to control circuitry 22. Control circuitry 22 is configured to control the motor to rotate at a speed that allows the flow rate measured by sensor 26 to be substantially constant for the initial period at or close to a maximum flow rate that the filter 30 is configured to support. In this way, the size of the filter can be reduced and yet the pump down time will not be increased unduly.

The flow rate sensor may be a volumetric or mass flow rate sensor. Although the flow rate sensor 26 is shown in this embodiment on the exhaust of the pump it may in other embodiments be located elsewhere within the system.

Figure 3:
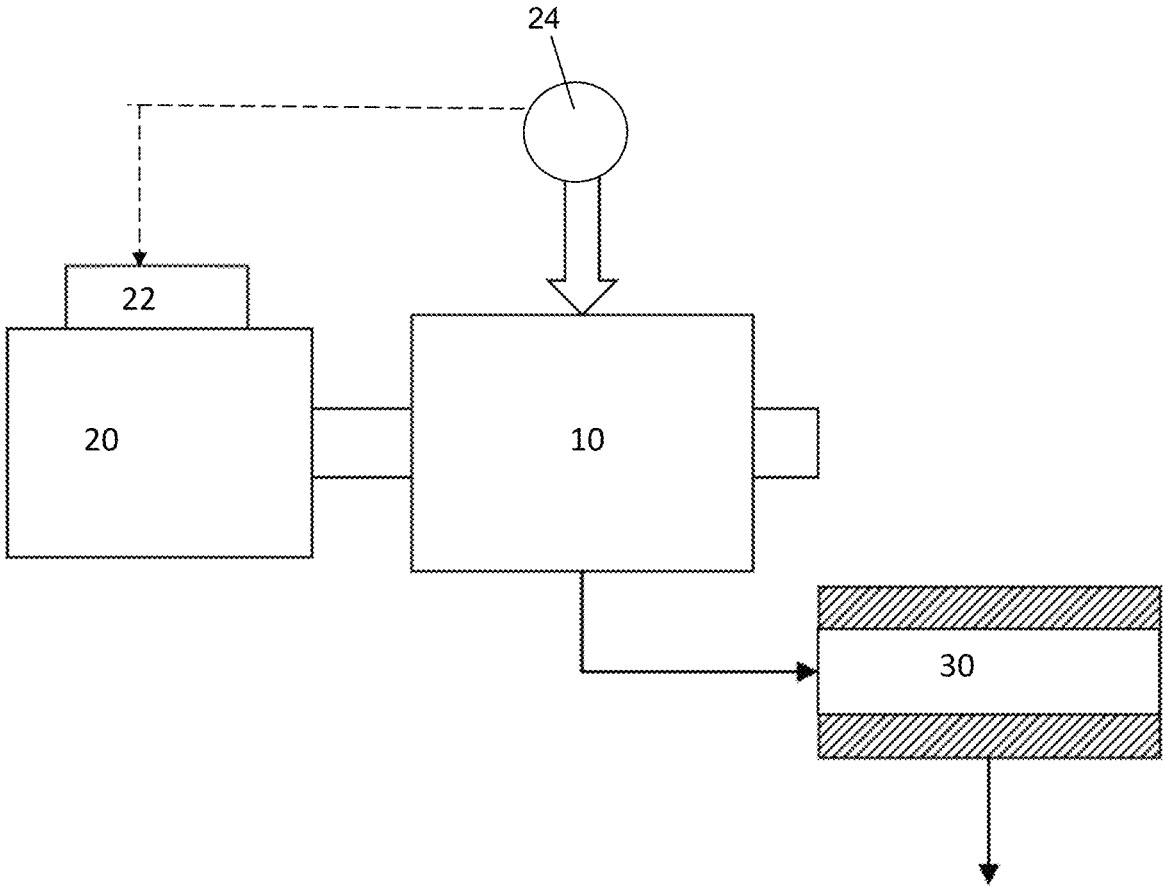
FIG. 3 schematically shows a vacuum pump where the rotational speed is controlled in dependence upon pressure according to an embodiment.

FIG. 3 shows an alternative embodiment where control circuitry 22 receives a signal from a pressure sensor 24. In this embodiment the pressure sensor directly measures the pressure of the gas at the input to the pump. In other embodiments pressure may be sensed at a different part of the pump or it may be sensed indirectly by, for example, sensing the torque exerted by the motor on the rotor. Control circuitry 22 controls the speed of the motor and thus, the speed of the rotor in dependence upon the pressure of the fluid being pumped. As noted previously, the filter 30 is configured for a particular maximum flow rate and the flow rate of the gas being pumped will depend on its pressure and the rotational speed of the rotor. Thus, depending on the pressure the rotational speed of the rotor can be controlled to maintain the fluid flow below this maximum flow rate. Again this control of the motor allows effective and accurate control of a flow rate to protect the filter from being overloaded without unduly reducing the initial pump down time.

Figure 4:
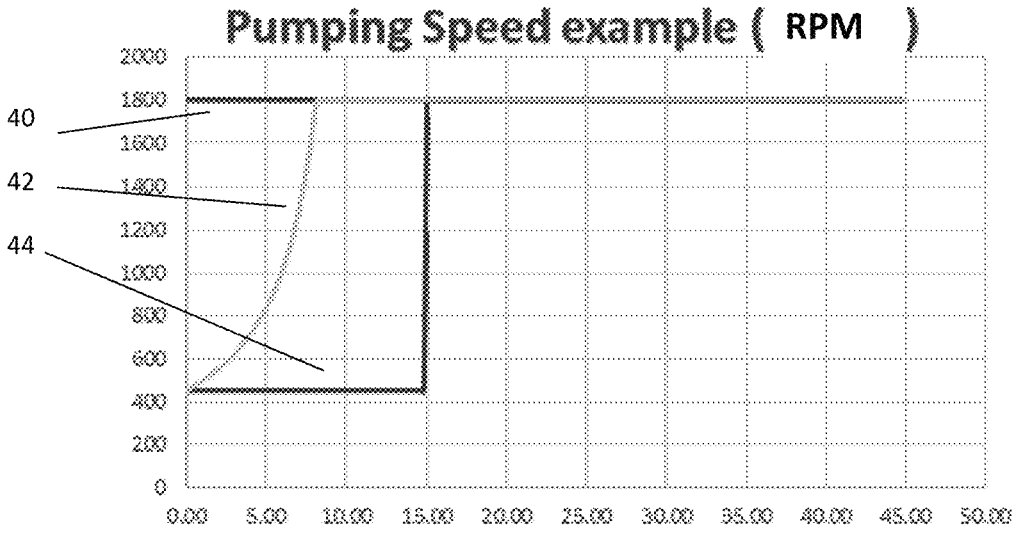
FIG. 4 shows different examples of controlled rotor speed according to an embodiment.

FIG. 4 shows examples of different ways in which the rotational speed of a pump's rotor may be controlled to change over time. Curve 40 shows a constant rotational speed of 1800 rpm and this represents a conventional pump which operates at an operational speed of 1800 rpm from start up until the end of the pumping cycle.

Curve 42 shows rotor speed variations according to one embodiment, where an initial low speed of 400 rpm is increased over a startup time in response to readings from a sensor, using a feedback loop to provide a substantially constant mass flow rate through the pump during initial the startup time until the maximum operational speed of the pump is reached.

Curve 44 shows an alternative embodiment where an initial low speed of 400 rpm is provided for a set period of time and is then increased to the operational speed of the pump.

Figure 5:
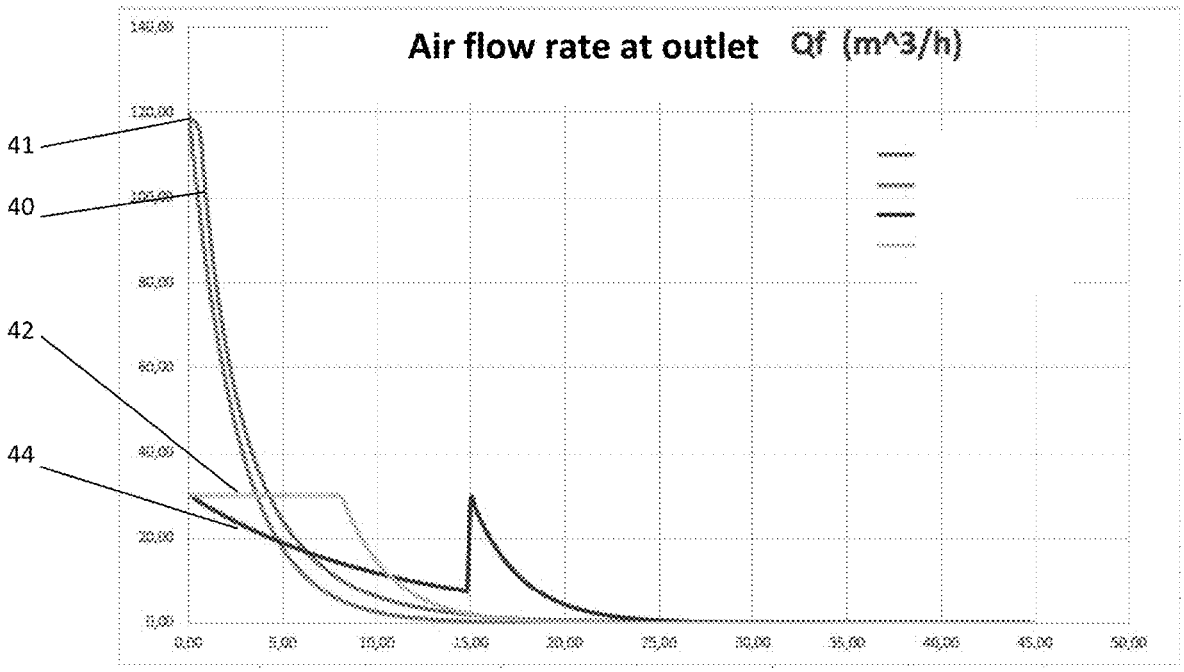
FIG. 5 shows the flow rate of fluid pumped by rotors rotating at the rotor speeds shown in FIG. 4.

FIG. 5 shows the impact of the different pumping speeds of FIG. 4 on the flow rate through the pump and on the pump down times. In addition to curves 40, 42 and 44 corresponding to those of FIG. 4, there is also curve 41 which is a theoretical curve for a constant flow rate of a conventional pump which corresponds to curve 40 that shows the measured curve for such a conventional pump. As can be seen from this figure the control of the speed according to curve 42 provides a constant maximum flow rate during the initial startup period which flow rate decreases once the maximum operational speed is reached.

Curve 44 shows how a constant reduced speed during the startup period provides a flow rate that gradually decreases as the pressure decreases. When the point at which the pump speed is increased to operational maximum speed is reached, there is a sharp increase in flow rate. The point at which this speed is increased is set so that this peak does not rise above the maximum flow rate that is acceptable to the filter of the pump.

As can be seen the pump down time for the different examples of pumping speeds varies, it being lowest for a conventional pump. The pump down time, shown by curve 42 with the variable reduced speed is lower than the pump down time required for curve 44, where the reduced speed is constant. However, a variable pumping speed such is provided by curve 42 may require a sensor to provide the feedback to maintain the flow rate close to the maximum value that the reduced sized filter can support.

In the examples of FIGS. 4 and 5, the initial rotor speed is 400 rpm for both example embodiments (42, 44) and this initial speed will set the maximum flow rate and determine the size of filter required. In this example, it is less than a quarter of the operational speed and thus, the filter can be correspondingly reduced in size.

Figure 6:
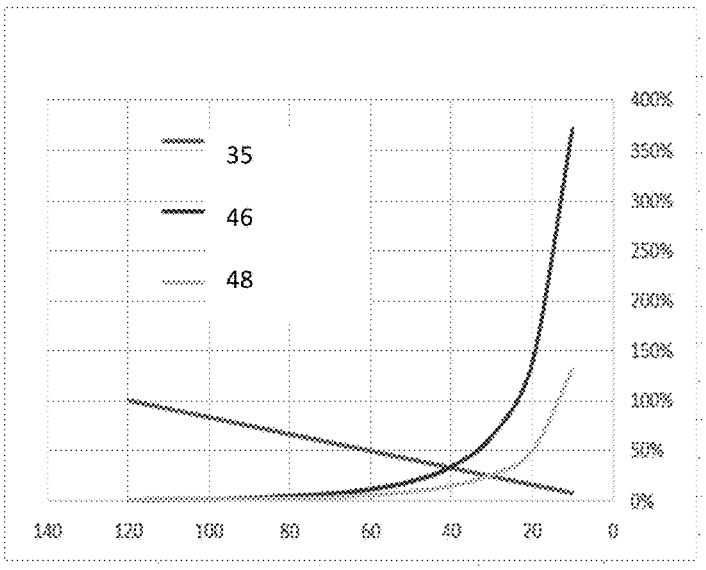
FIG. 6 shows a comparison of the rotational speed versus increase in pump down time and decrease in filter size.

FIG. 6 shows how both the required size of the filter shown by curve and the time for pump down increases as the maximum flow rate that the pump is configured for is decreased for both mass and volumetric flow rate limits. These reduced maximum flow rates are provided by providing a reduced initial rotational speed of the pump. Curve 46 shows how the time increases where the maximum flow rate is limited by volumetric flow, while curve 48 shows how the time increases where the flow rate is limited by mass flow rate.

TABLE 1 below provides this information in table form.

| Maximum flow rate | Size of the filter (%) | time (s) | Pump-down time(s) | time increase (%) Lim Volume flow | Temps (s) | Time increase (%) Lim mass flow |
|---|---|---|---|---|---|---|
| 120 | 100% | 17.8 | 17.8 | 0% | 17.8 | 0% |
| 110 | 92% | 17.8 | 18.0 | 1% | 18.0 | 1% |
| 100 | 83% | 17.8 | 18.0 | 1% | 18.0 | 1% |
| 90 | 75% | 17.8 | 18.2 | 2% | 18.0 | 1% |
| 80 | 67% | 17.8 | 18.6 | 4% | 18.2 | 2% |
| 70 | 58% | 17.8 | 19.0 | 7% | 18.4 | 3% |
| 60 | 50% | 17.8 | 19.8 | 11% | 18.8 | 6% |
| 50 | 42% | 17.8 | 21.2 | 19% | 19.4 | 9% |
| 40 | 33% | 17.8 | 23.8 | 34% | 20.4 | 15% |
| 30 | 25% | 17.8 | 29.2 | 64% | 22.4 | 26% |
| 20 | 17% | 17.8 | 42.2 | 137% | 26.6 | 49% |
| 10 | 8% | 17.8 | 84.0 | 372% | 41.2 | 131% |

As can be seen from the graph of FIG. 6 and from table 1, where the maximum flow rate is set to 120, this corresponds to the flow rate of a conventional pump and the filter required is that of the conventional pump, and this is set as 100%. The pump down time is the pump down time of a conventional pump which is in this case 17.8 seconds. Where the maximum flow rate is decreased from 120 to 110, so by 8% the size of the filter is correspondingly reduced by 8% whereas the pump down time increases by 1% for both volumetric and mass flow rate. As the maximum flow rate continues to decrease so the pump down times increase and the size of the filter decreases. As can be seen from FIG. 6 there is an optimal point where the size of the filter has decreased significantly and yet the pump down times have not increased significantly. This occurs at a flow rate of about 30 which is quarter of the maximum flow rate, and beyond this the pump down times increase significantly. This reduced flow rate requires a size of filter that is about a quarter of the size of the standard filter for the conventional pump.

Figure 7:
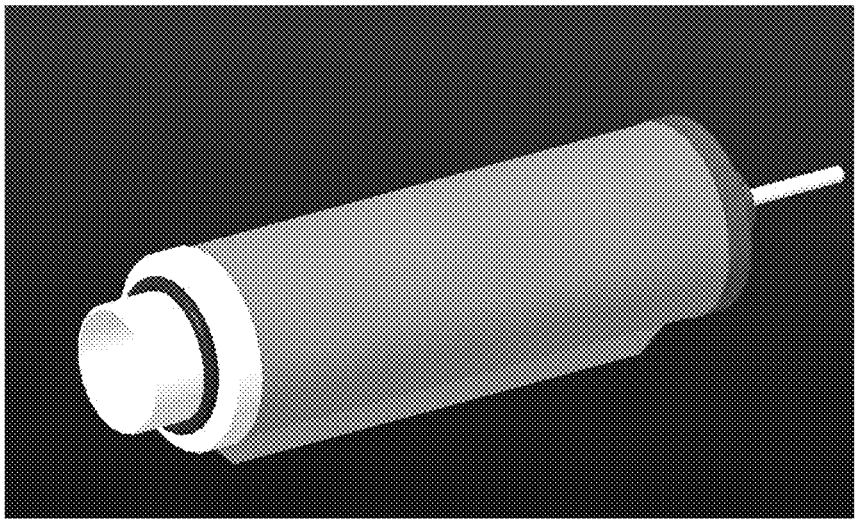
FIG. 7 shows a filter according to an embodiment.

FIG. 7 shows filter 30 according to an embodiment.

Figure 8:
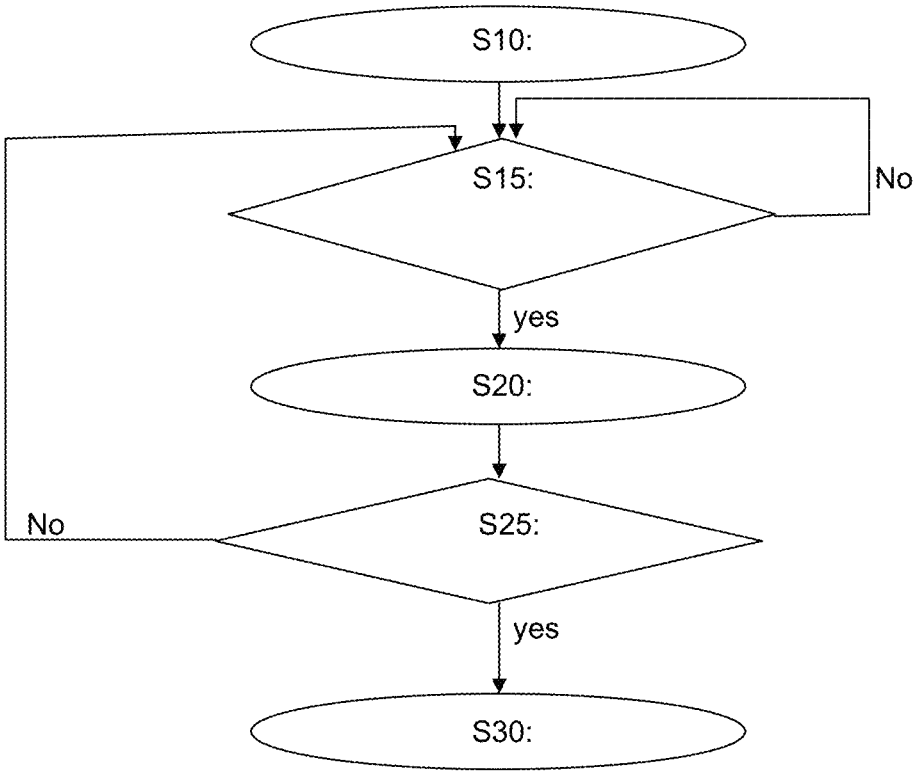
FIG. 8 shows a flow diagram showing a method of evacuating a chamber according to an embodiment.

FIG. 8 shows a flow diagram illustrating steps in a method for evacuating a chamber according to an embodiment. At an initial step S10, the rotor is rotated at an initial speed. The initial speed is set so that the maximum air flow is less than a predetermined value. This maximum air flow determines the size of the filter. There is a feedback loop in the method whereby the flow rate is monitored and the rotor speed increased in response to the flow rate being detected as falling. This feedback loop involves determination at S15 of whether the flow rate has dropped below a fixed value and if it has the rotor speed is increased by a fixed amount delta at step S20. In this way the rotor speed is maintained substantially constant. When the rotor speed is determined to have reached the maximum operational speed of the pump at step S25, that is the operational speed during the normal pumping process the control process for adjusting the speed is stopped and the rotational speed of the rotor is maintained at step S30, at this operational maximum speed during the rest of the pumping process.

In summary, the initial speed of rotation of the rotor is constrained to reduce the maximum air flow and this in turn reduces the size of lubricant filter required to clean the lubricant from the fluid output by the pump.

In this regard the size of the filter required is related to the maximum flow rate of the fluid being pumped by the equation:

$$S=Q/(\text{permeability}\times P)$$

Where S: is the filtration surface in $m^2$ (for a cylindrical filter $S=\pi r^2 L$)

Where L: (m) length of the filter, and r: (m) radius of the filter

P: is the acceptable pressure drop across the filter

Q: air flow ($m^3/s$)

Permeability: is a filter parameter $m^3/(m^2\times Pa\times s)$

The pressure drop across the filter and the permeability of the filter are properties of the filter and thus, setting the maximum flow rate of the pump to a size for the filter. Reducing the maximum flow rate, which is the initial flow rate to less than half of the conventional initial flow rate by reducing the speed of rotation of the rotor allows the size of the filter to be reduced correspondingly by more than a half.

Different speed control modes can be used to control the initial rotational speed of the rotor and thereby the initial flow of the fluid. These include:

1. limitation of the Initial speed
2. the initial Speed is ramped-up from an initial low value, the slope of the ramp depending on the vessel size being evacuated
3. the speed may have an initial low value for a predetermined time dependent on the vessel size being evacuated
4. the initial speed may be regulated by a loop feedback control that is dependent on the air flow, measured in some embodiments at the exhaust
5. the initial speed can be regulated by a loop feedback control dependent on the pressure measured in some embodiments at the inlet of the pump Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A lubricant-sealed vacuum pump configured to pump fluid from an inlet to an exhaust, said lubricant-sealed vacuum pump comprising:

a rotor;

a motor for rotating said rotor;

a filter for filtering lubricant from fluid to be output by said pump;

control circuitry for controlling a speed of rotation of said rotor, said control circuitry being configured to control rotation of said rotor such that said rotor rotates at a fixed speed for a predetermined period of time during which a pressure at the inlet is reduced and after the predetermined period of time, rotates at a higher operational speed, wherein the predetermined period of time is selected such that a flow rate of the fluid through the filter does not exceed a maximum flow rate that the filter supports both during and after the predetermined period of time.

2. The lubricant-sealed vacuum pump according to claim 1, wherein said motor comprises a variable speed motor for driving said rotor, said control circuitry being configured to control said speed of rotation of said rotor by controlling a speed of rotation of said motor.

3. The lubricant-sealed vacuum pump according to claim 1, wherein said fixed speed is less than a half of said higher operational speed.

4. A filter for a lubricant-sealed vacuum pump, the lubricant-sealed vacuum pump having an inlet and a rotor that rotates at an initial speed when a pressure at the inlet is high and rotates at an operational speed higher than the initial speed when the pressure at the inlet is reduced, said filter comprising a filtration surface area that is smaller than or equal to a volumetric flow rate of the lubricant-sealed vacuum pump when the rotor rotates at the initial speed divided by a permeability and pressure drop across the filter.

* * * * *